US005468169A

United States Patent [19]

Kane et al.

[11] Patent Number: 5,468,169

[45] Date of Patent: Nov. 21, 1995

[54] FIELD EMISSION DEVICE EMPLOYING A SEQUENTIAL EMITTER ELECTRODE FORMATION METHOD

[75] Inventors: Robert C. Kane, Woodstock, Ill.; Kevin B. Hilgers, Mesa, Ariz.

[73] Assignee: Motorola, Schaumburg, Ill.

[21] Appl. No.: 732,295

[22] Filed: Jul. 18, 1991

[51] Int. Cl.[6] ..... H01J 9/02

[52] U.S. Cl. ..... 445/50

[58] Field of Search ..... 445/24, 50, 52; 313/309, 336

[56] References Cited

U.S. PATENT DOCUMENTS

| | | | |
|---|---|---|---|
| 3,789,471 | 2/1974 | Spindt et al. | 445/52 |
| 4,600,397 | 7/1986 | Kawakubo et al. | 445/24 X |
| 4,766,340 | 8/1988 | van der Mast | 313/309 X |
| 5,007,873 | 4/1991 | Goronkin et al. | 313/309 X |
| 5,064,396 | 11/1991 | Spindt | 313/309 X |
| 5,075,591 | 12/1991 | Holmberg | 313/309 X |

*Primary Examiner*—Kenneth J. Ramsey
*Attorney, Agent, or Firm*—Eugene A. Parsons

[57] ABSTRACT

A method of forming an electron emitter for an FED by means of successive evaporative material depositions, providing a flexibility of electron emitter formation which removes geometry constraints that limited the form of prior art field emission device electron emitters. The resultant field emission device yields improved performance as a result of increased insulator layer thickness and electron emitter aspect ratio.

2 Claims, 4 Drawing Sheets

-PRIOR ART-

-PRIOR ART-

-PRIOR ART-

FIELD EMISSION DEVICE EMPLOYING A SEQUENTIAL EMITTER ELECTRODE FORMATION METHOD

FIELD OF THE INVENTION

The present invention relates generally to cold-cathode field emission devices and more particularly to a method for realizing field emission device electron emitters.

BACKGROUND OF THE INVENTION

Field emission devices (FEDs) are known in the art and may be realized using a variety of methods some of which require complex materials deposition techniques and others which require undesirable etch steps.

Typically FEDs are comprised of an electron emitter electrode, a gate extraction electrode, and an anode electrode although two element structures comprised of only an electron emitter electrode and anode are known. In a customary application of an FED an appropriate externally provided potential is applied to the gate extraction electrode so as to induce an electric field of suitable magnitude and polarity such that electrons may tunnel through a reduced surface potential barrier of finite extent with increased probability. Emitted electrons, those which have escaped the surface of the electron-emitter electrode into free-space, are generally preferentially collected at the device anode. In a two element structure the gate extraction electrode will serve also as the anode for the purpose of collecting emitted electrons.

Various device geometries which may be realized using the known methods include FEDs which emit electrons substantially perpendicularly with respect to a supporting substrate. One such geometry employs a conic shaped electron emitter disposed on a substrate or conductive surface and having an apex which forms a geometric discontinuity of small radius of curvature at which apex electrons are preferentially emitted. Techniques for forming such electron emitters, known in the art, are restricted with respect to the shapes and sizes of electron emitter structures which may be realized.

Accordingly, there is a need for a field emission device and/or a method for forming a field emission device which overcomes at least some of the shortcomings of the prior art.

SUMMARY OF THE INVENTION

This need and others are substantially met through provision of a method of forming a field emission device including an electron emitter including the steps of providing a supporting substrate having a major surface, depositing an insulator layer on the major surface of the supporting substrate, depositing a conductive layer on the insulator layer, selectively etching a part of each of the conductive layer and insulator layer to form a chamber wherein the major surface of the supporting substrate is exposed and an aperture to the chamber lies generally in the conductive layer, depositing a first lift-off layer on the conductive layer by means of evaporative material deposition, performing a first substantially normal evaporative material deposition on the first lift-off layer to at least partially close the aperture to the chamber and form a portion of an electron emitter within the chamber disposed on the major surface of the supporting substrate, selectively removing the first lift-off layer and substantially all of any material disposed thereon, depositing a second lift-off layer on the conductive layer by means of evaporative material deposition, and performing a second substantially normal evaporative material deposition on the second lift-off layer to at least partially close the aperture to the chamber such that a multi-portion substantially conic/wedge shaped electron emitter is formed within the chamber and disposed substantially on a portion of the major surface of the substrate.

This need and others are also substantially met through provision of a field emission device comprising a supporting substrate having a major surface, an insulator layer disposed on the major surface of the supporting substrate having defined therein a chamber with an aperture substantially bounded by the insulator layer, a conductive layer disposed on the insulator layer, and a substantially conic/wedge shaped electron emitter disposed within the chamber on the major surface of the supporting substrate, the conic/wedge shaped electron emitter including a plurality of separate substantially normal evaporative material depositions.

DETAILED DESCRIPTION OF PREFERRED EMBODIMENTS

Figure 1A:
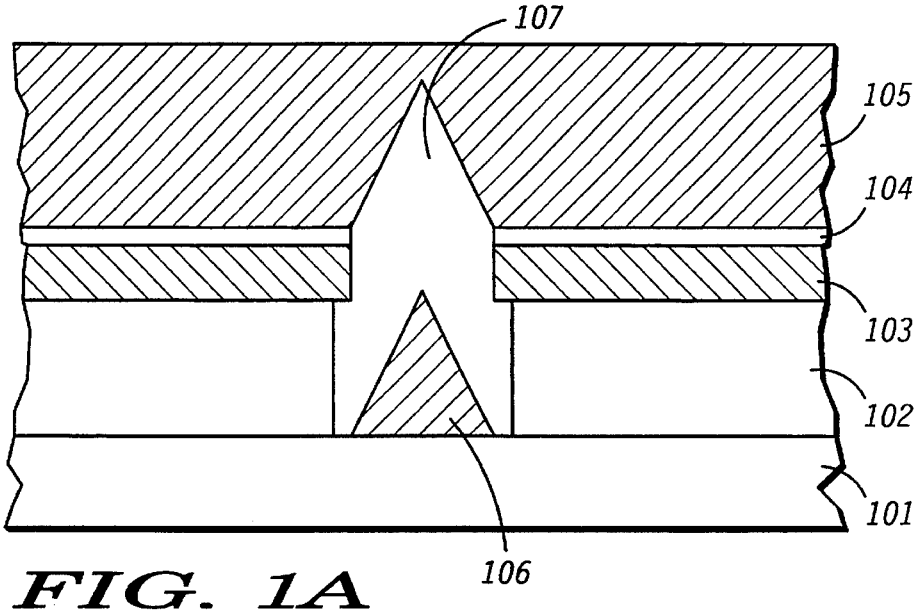
FIG. 1A is a partial side-elevational depiction of a first embodiment of a field emission device formed by employing the fabrication techniques of the prior art.

Referring now to FIG. 1A there is shown a partial side-elevational view of a field emission device realized by a method known in the prior art. An electron emitter electrode 106 is shown disposed on a supporting substrate 101 and further disposed in a chamber 107 formed in an insulator layer 102. A conductive layer 103 is disposed on insulator layer 102 and functions as a gate extraction electrode. A lift-off layer 104 and encapsulation layer 105 are also depicted.

The device of FIG. 1A is typically formed by depositing insulator layer 102 on supporting substrate 101 and subsequently depositing conductive layer 103 onto insulator layer 102. A selective etch is then performed to provide chamber 107 bounded by the surface formed by selective etching of insulator layer 102. After formation of chamber 107 a low-angle evaporation of material is performed to provide lift-off layer 104 disposed on conductive layer 103 and not within aperture 107 nor on the aperture bounding surface of insulator layer 102. A substantially normal (perpendicular with respect to the supporting substrate) evaporative material deposition is performed to form encapsulation layer 105.

The normal deposition of material has an inherent small radial component to the velocity of the material being deposited. As material of the normal evaporative material deposition is deposited onto the structure there is a tendency for the aperture of chamber 107 to become smaller as some of the deposited material overhangs the aperture of chamber 107. As the deposition proceeds the aperture of chamber 107 closes entirely. During the normal evaporative material deposition as the aperture of chamber 107 continuously becomes smaller less material is deposited into chamber 107. Also, as the aperture of chamber 107 becomes smaller any material deposited into chamber 107 is restricted to be deposited axially symmetrically with respect to the reduced aperture. This gives rise to the formation of conic electron emitter electrode 106.

Conic electron emitter electrode 106 exhibits an apex with a geometric discontinuity of small radius of curvature. Such an electron emitter electrode facilitates electron emission when the device is placed in operation.

It is also desired, for the purpose of facilitating electron emission from electron emitter electrode 106 that the cone angle, of the conic electron emitter electrode formed, be as nearly normal with respect to the supporting substrate as can be achieved. To achieve high angle cone formation the methods of the prior art have typically required that the evaporative material source to substrate distance be on the order of 20 to 40 inches. Further, since the rate of closure of the aperture determines the deposition time period which, in turn, determines the height of electron emitter electrode 106, the thickness of insulator layer 102 is pre-determined so that the apex of conic electron emitter electrode 106 is preferentially disposed in the plane of conductive layer 103.

In some fabrication methods known in the art a selectively patterned conductive layer is deposited onto the major surface of the supporting substrate prior to deposition of the insulator layer. The purpose of such a selectively patterned conductive layer is to provide an operable contact between the electron emitter electrodes which will be subsequently formed and any externally provided potential sources which are employed for device operation. In such an instance the selectively patterned conductive layer is a first conductive layer and a second conductive layer is deposited on the insulator layer to function as the gate extraction electrode.

Figure 1B:
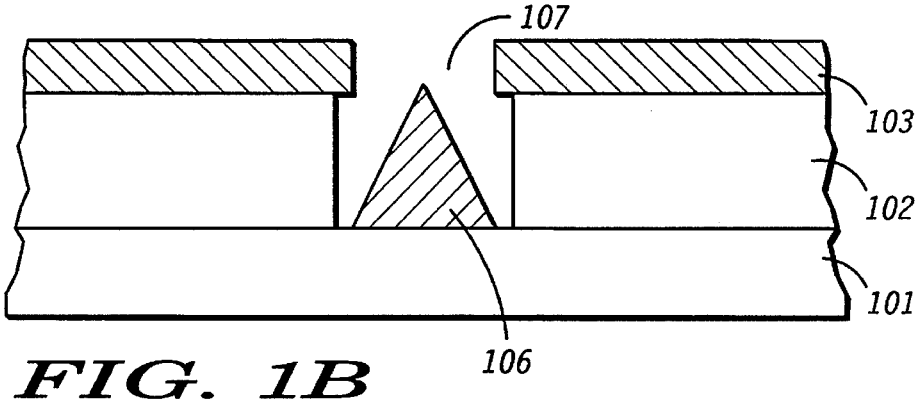
FIG. 1B is a partial side-elevational depiction of a second embodiment of a field emission device formed by employing the fabrication techniques of the prior art.

FIG. 1B is a partial side-elevational depiction of the device of the prior art as described previously with reference to FIG. 1A and wherein lift-off layer 104 and encapsulation layer 105 have been removed by performing an etch step which preferentially reacts with the material of lift-off layer 104 while substantially not reacting with the other layers of the structure.

Figure 2:
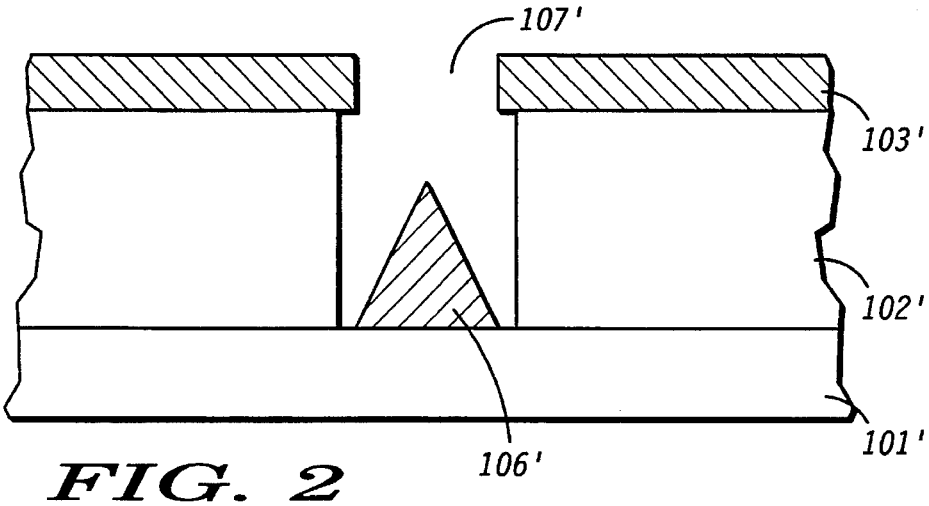
FIG. 2 is a partial side-elevational depiction of a third embodiment of a field emission device formed by employing the fabrication techniques of the prior art.

Referring now to FIG. 2 there is depicted another prior art field emission device constructed in accordance with the methods described previously with reference to FIGS. 1A & 1B wherein an electron emitter electrode 106' is shown disposed non-optimally with respect to the plane of a conductive layer 103'. The structure of FIG. 2 is typically the result of the aperture of a chamber 107' being of the wrong diameter to correlate with the thickness of an insulator layer 102' to yield electron emitter electrode 106' with cone apex residing in the plane of conductive layer 103'. The structure of FIG. 2 typically results when the aperture of chamber 107' is too small with respect to the thickness of insulator layer 102'. The prior art methods of electron emitter electrode formation generally require a chamber aperture diameter to insulator layer thickness aspect ratio of about 1.0.

Figure 3A:
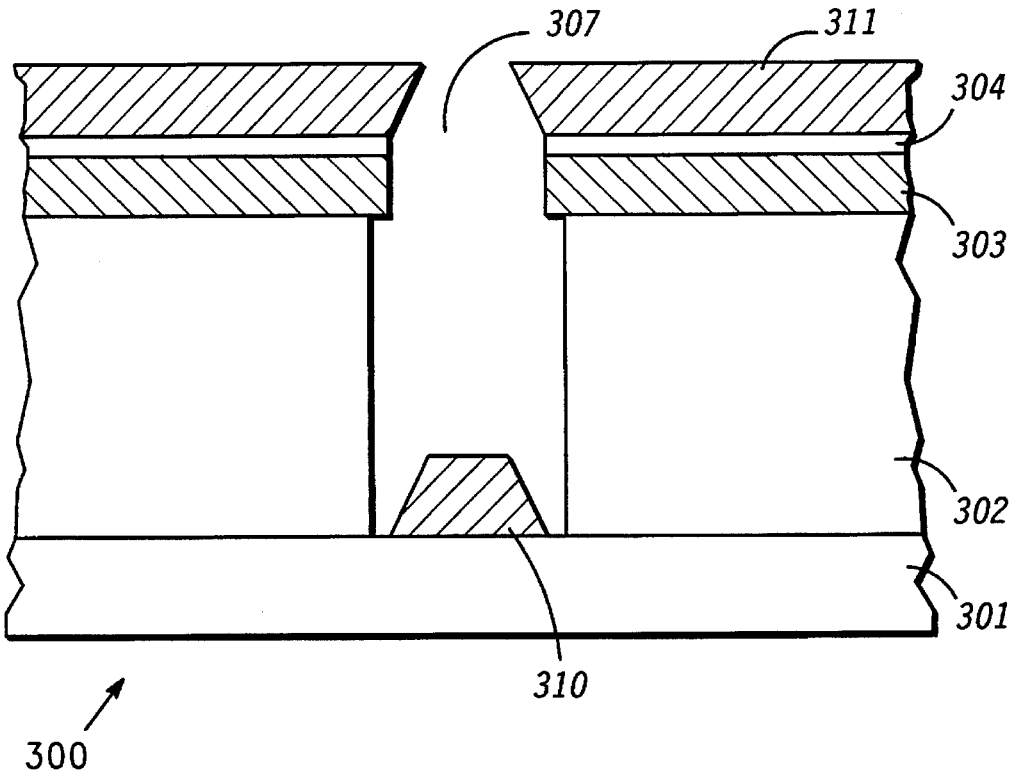
FIGS. 3A–3D are partial side-elevational depictions of structures realized by performing various steps of a method of forming a field emission device electron emitter electrode in accordance with the present invention.

Referring now to FIG. 3A there is shown a partial side-elevational depiction of a structure 300 of the present invention. Structure 300 includes a supporting substrate 301, an insulator layer 302, a conductive layer 303, a lift-off layer 304, and an aperture 307, all of which are similar to structure described previously with reference to FIG. 1A. Supporting substrate 301, as described in this disclosure, is a conducting layer of material and may be a heavily doped semiconductor layer, a metal layer, or some combination of the two and may actually be the substrate of a semiconductor chip or may be layers grown on other layers and supported by the substrate. In this specific embodiment supporting substrate 301 not only forms a support for the completed FED but provides an electrical connection to the electron emitter electrode. FIG. 3A further depicts a partially formed encapsulation layer 311 and a partially formed electron emitter electrode 310. A substantially normal evaporative material deposition is terminated prior to full encapsulation of chamber 307 which results in termination prior to complete formation of a conic electron emitter electrode.

Figure 3B:
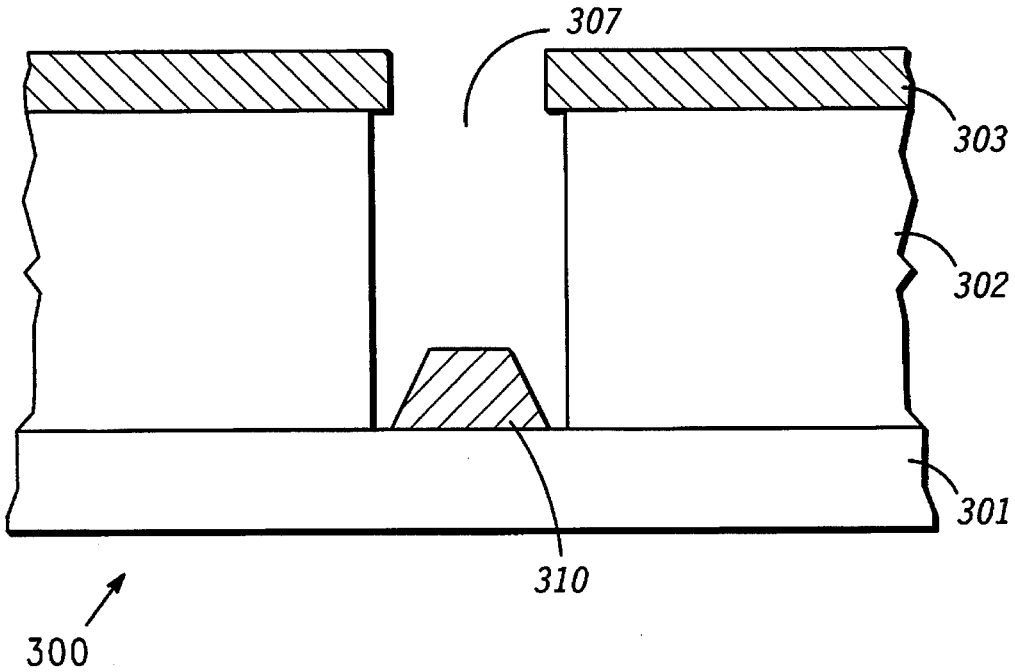

FIG. 3B depicts structure 300 having undergone additional processing steps including the step of removing the lift-off layer 304 and all of the material of encapsulation layer 305 disposed thereon.

Figure 3C:
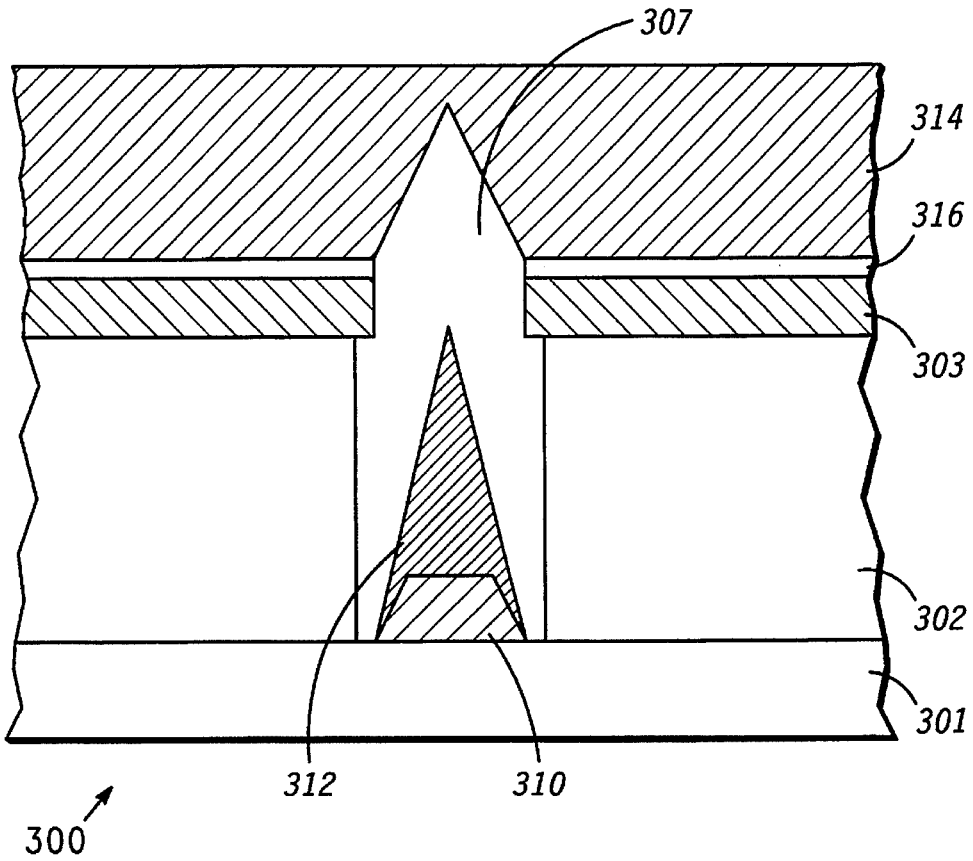

FIG. 3C is a partial side-elevational depiction of structure 300 having undergone additional processing steps. A second lift-off layer 316 is provided by a technique similar to that previously described with reference to the first lift-off layer 304 illustrated in FIG. 1A. A substantially normal evaporative material is deposited to form a second encapsulation layer 314 which completes the electron emitter electrode by depositing a tip 312, formed of the material of layer 314, on the partially formed electron emitter 310.

The structure of FIG. 3C depicts that by performing the disclosed method a field emission device employing an electron emitter electrode is realized wherein the thickness of insulator layer 302 is independent of the chamber aperture diameter and wherein the thickness of insulator layer 302 may be substantially increased to provide improved device operation irrespective of the aperture diameter of chamber 307. This translates to field emission device structures with insulator layer thickness chamber aperature diameter aperture ratios greater than 1.0. It should be further observed that by employing the multiple substantially normal evaporative material depositions of the first method of the present invention that the height of the electron emitter electrode so formed is increased over that which is realized by employing the known methods of the prior art. At the same time the diameter of the base of the conic electron emitter remains unchanged the result of which is that the angle of formation of the conic electron emitter is greater than that which can be achieved by the methods of the prior art.

Figure 3D:
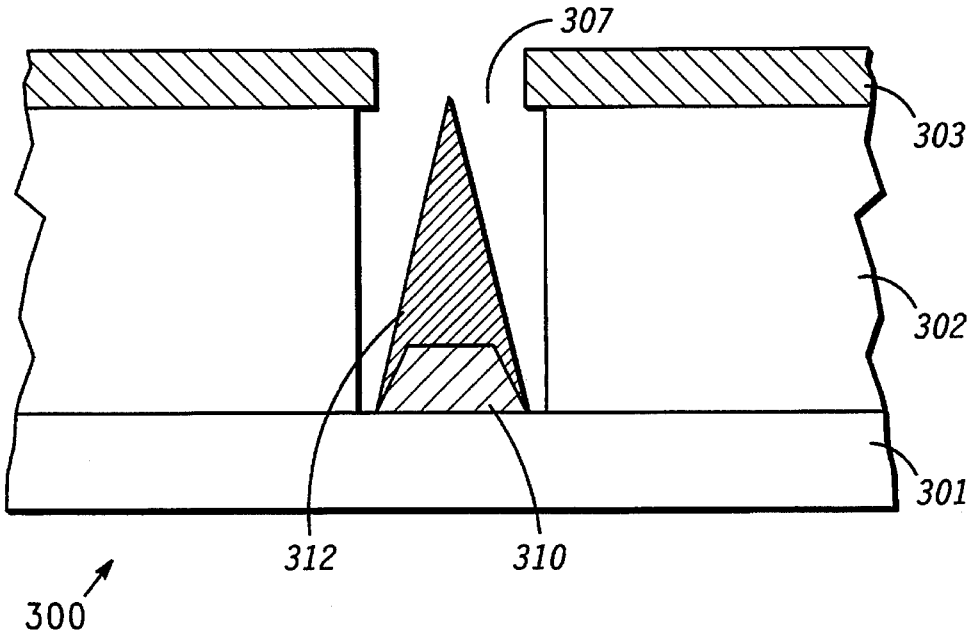

FIG. 3D is a partial side-elevational depiction of field emission device structure 300 having undergone additional steps including the step of removing lift-off layer 316 and all of the material of second encapsulation layer 314 by an etch process similar to that described previously with reference to FIG. 1B.

Figure 4:
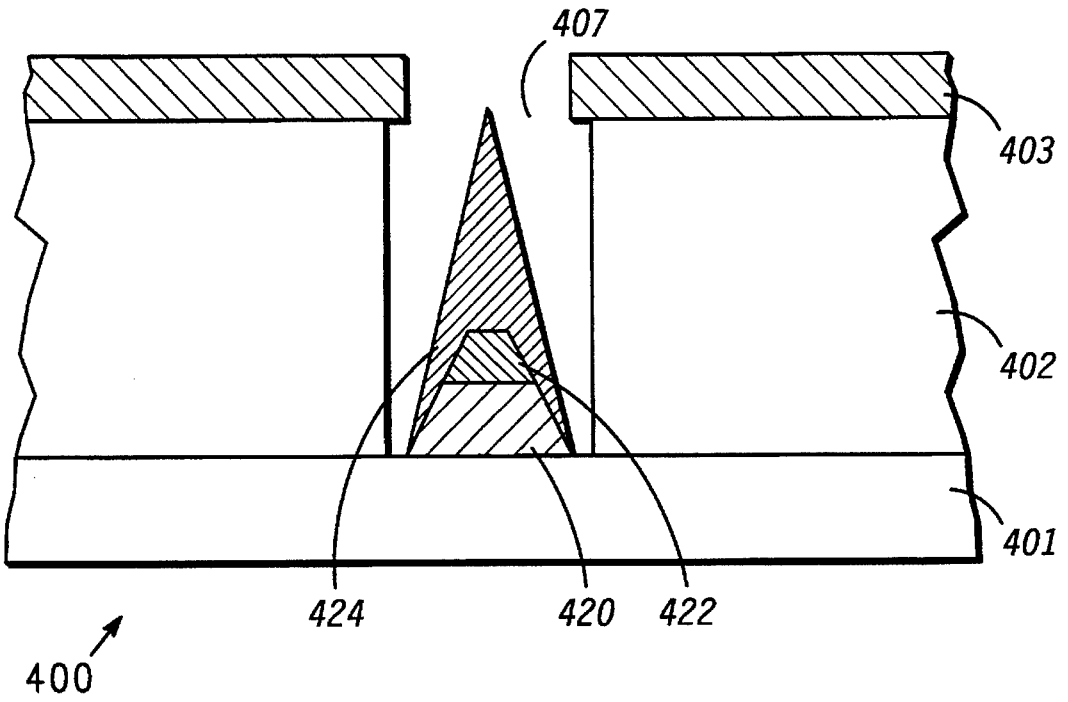
FIG. 4 is a partial side-elevational depiction of an embodiment of a field emission device realized by performing the steps of another method of forming an electron emitter electrode in accordance with the present invention.

Referring now to FIG. 4 there is depicted a side-elevational view of a structure 400 similar in part to structure 300 described previously with reference to FIGS. 3A & 3B. Structure 400 includes a substrate 401, an insulator layer 402 and a conductive layer 403 with a chamber 407 formed in layers 402 and 403. Structure 400 differs from structure 300 in that it has undergone an additional step of performing a substantially normal evaporative material deposition of a layer 422, which deposition is terminated prior to the full closure of the aperture of chamber 407. The deposition step is repeated more than a single time such that a plurality of partially formed electron emitter electrode components, 420 and 422, are provided. A lift-off layer (not shown) is provided prior to performing each of the plurality of substantially normal evaporative material depositions. The lift-off layer is subsequently etched as described previously with reference to FIG. 3B. A final substantially normal evaporative material deposition is allowed to proceed until the aperture is closed, in which instance a complete electron emitter electrode including partial emitter electrode components 420 and 422 and electron emitter electrode tip 424 is formed. FIG. 4 illustrates structure 400 with the lift-off layers and overlying encapsulation layers removed.

Figure 5:
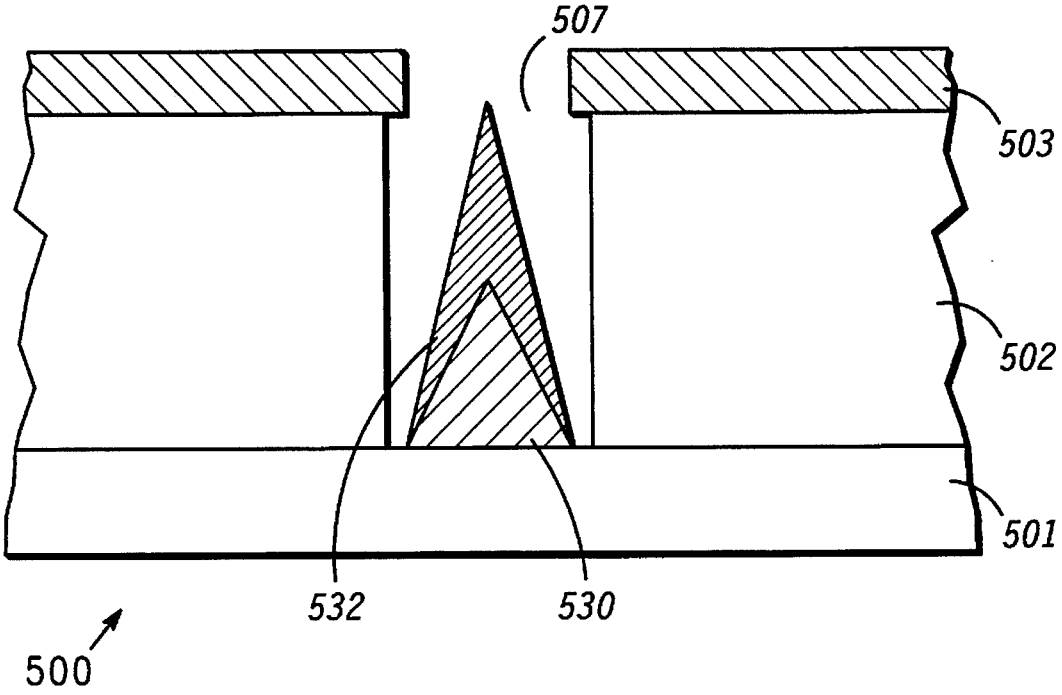
FIG. 5 is a partial side-elevational depiction of another embodiment of a field emission device realized by performing the steps of still another method of forming an electron emitter electrode in accordance with the present invention.

FIG. 5 is a partial side-elevational depiction of a device 500 realized by performing the steps of another method in accordance with the present invention. Device 500 includes a substrate 501, an insulator layer 502 and a conductive layer 503, with a chamber 507 formed in layers 502 and 503. This method differs from the previously described methods in that each of a plurality of substantially normal evaporative material depositions is carried out until the aperture of chamber 507 is substantially closed. As a result of performing a first substantially normal evaporative material deposition, a first electron emitter electrode 530 is formed within chamber 507. By performing a second substantially normal evaporative material deposition a second electron emitter electrode 532 is formed substantially disposed on first electron emitter electrode 530. The resultant electron emitter electrode, including first and second electron emitter electrodes 530 and 532, exhibits a greater aspect ratio corresponding to a greater cone angle and provides for a method of employing a greater thickness of insulator layer 502 which results in improved field emission device performance.

An additional feature of the methods described is that the evaporative material source to substrate distance in the evaporative deposition steps may be reduced to the order of 10 inches, if desired, without negatively impacting the performance of the field emission devices which are fabricated. By employing the methods described the accelerated closure rate, which results from reducing the material source to substrate distance, is of no consequence since repeated evaporative depositions are employed to provide a composite electron emitter electrode. Further, by reducing the distance from material source to substrate the rate at which the evaporative process proceeds is increased significantly which yields a higher throughput for fabrication of field emission devices.

Although only conic shaped electron emitter electrodes have been described in detail it is anticipated that the described methods may be employed to realize other electron emitter shapes known in the art such as, for example, wedge shaped and serpentine shaped electron emitters, since the shape of the electron emitter is primarily dependent on the shape of the chamber provided.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

What we claim is:

1. A method of forming a field emission device including an electron emitter comprising the steps of:

providing a supporting substrate having a major surface;

depositing an insulator layer on the major surface of the supporting substrate;

depositing a conductive layer on the insulator layer;

selectively etching a part of each of the conductive layer and insulator layer to form a chamber wherein the major surface of the supporting substrate is exposed and an aperture to the chamber lies generally in the conductive layer;

depositing a first lift-off layer on the conductive layer by means of evaporative material deposition;

performing a first substantially normal evaporative material deposition on the first lift-off layer to partially close the aperture to the chamber and form a portion of an electron emitter within the chamber disposed on the major surface of the supporting substrate, the first substantially normal evaporative material deposition being terminated prior to formation of a conic/wedge shaped electron emitter within the chamber;

selectively removing the first lift-off layer and substantially all of any material disposed thereon;

depositing a second lift-off layer on the conductive layer by means of evaporative material deposition; and performing a second substantially normal evaporative material deposition on the second lift-off layer to at least partially close the aperture to the chamber such that a substantially conic/wedge shaped electron emitter is formed within the chamber, the second material deposition being disposed substantially on the portion of the electron emitter formed by the first material deposition.

2. A method of forming a field emission device including an electron emitter comprising the steps of:

providing a supporting substrate including a conductor and having a major surface;

depositing an insulator layer on exposed portions of the substrate and the conductor;

depositing a conductive layer on the insulator layer;

selectively etching the conductive layer and the insulator layer to form a chamber wherein at least a part of the conductor is exposed and an aperture to the chamber lies generally in the conductive layer;

depositing a first lift-off layer on the conductive layer by means of evaporative material deposition;

performing a first substantially normal evaporative material deposition on the first lift-off layer to partially close the aperture to the chamber and form a portion of an electron emitter within the chamber disposed on the major surface of the supporting substrate and in contact with the conductor, the first substantially normal evaporative material deposition being terminated prior to formation of a conic/wedge shaped electron emitter within the chamber;

selectively removing the first lift-off layer and substantially all of any material disposed thereon;

depositing a second lift-off layer on the conductive layer by means of evaporative material deposition; and performing a second substantially normal evaporative material deposition on the second lift-off layer to at least partially close the aperture to the chamber such that a substantially conic/wedge shaped electron emitter is formed within the chamber and disposed substantially on the portion of the electron emitter.

* * * * *